US011753857B2

(12) United States Patent
Giovannetti

(10) Patent No.: US 11,753,857 B2
(45) Date of Patent: Sep. 12, 2023

(54) HINGE FOR THE OPENING AND CLOSING OF HINGED DOORS OF FURNITURE

(71) Applicant: EFFEGI BREVETTI S.R.L., Segrate (IT)

(72) Inventor: Antonio Giovannetti, Segrate (IT)

(73) Assignee: EFFEGI BREVETTI S.R.L., Milan (IT)

( * ) Notice: Subject to any disclaimer, the term of this patent is extended or adjusted under 35 U.S.C. 154(b) by 124 days.

(21) Appl. No.: 17/603,817

(22) PCT Filed: Mar. 23, 2020

(86) PCT No.: PCT/EP2020/057956
§ 371 (c)(1),
(2) Date: Oct. 14, 2021

(87) PCT Pub. No.: WO2020/212086
PCT Pub. Date: Oct. 22, 2020

(65) Prior Publication Data

US 2022/0195776 A1 Jun. 23, 2022

(30) Foreign Application Priority Data

Apr. 15, 2019 (IT) ..... 102019000005758

(51) Int. Cl.

| | |
|---|---|
| ***E05F 3/22*** | (2006.01) |
| ***E05F 1/08*** | (2006.01) |
| ***E05F 3/20*** | (2006.01) |
| ***E05D 3/14*** | (2006.01) |

(52) U.S. Cl.
CPC ..... *E05F 3/20* (2013.01); *E05D 3/142* (2013.01); *E05Y 2201/212* (2013.01); *E05Y 2201/264* (2013.01); *E05Y 2201/626* (2013.01); *E05Y 2600/41* (2013.01); *E05Y 2900/20* (2013.01)

(58) Field of Classification Search
CPC ... E05F 1/08; E05F 1/10; E05F 1/1041; E05F 1/1091; E05F 1/12; E05F 1/1223;
(Continued)

(56) References Cited

U.S. PATENT DOCUMENTS 5,896,619 A * 4/1999 Koopman ..... E05F 1/1253 16/68
10,704,311 B1 * 7/2020 Collene ..... E05F 1/1261
(Continued)

FOREIGN PATENT DOCUMENTS

| | | |
|---|---|---|
| DE | 296 11 392 | 8/1996 |
| EP | 1 736 627 | 12/2006 |
| WO | 2016/174071 | 11/2016 |

OTHER PUBLICATIONS

International Search Report for PCT/EP2020/057956 dated Jun. 24, 2020, 3 pages.
(Continued)

*Primary Examiner* — Chuck Y Mah
(74) *Attorney, Agent, or Firm* — NIXON & VANDERHYE

(57) ABSTRACT

Hinge for the opening and the closing of hinged doors of furniture units, including a first fixed body designed to be housed in a seat of a horizontal plane of the structure of a furniture unit, such as a base or a top, and a second movable body designed to be housed in a seat of a door of the furniture unit, to actuate the door during opening and closing by way of a movement mechanism including at least one lever or connecting rod connecting a pin placed on the fixed part of the hinge and a pin placed on the movable part, wherein the closing force of the door is determined by a spring, the spring acting, with a tilting action, on an extension of the connecting rod beyond the hinge pin.

20 Claims, 6 Drawing Sheets

(58) Field of Classification Search
CPC ..... E05F 1/1246; E05F 1/1253; E05F 1/1261; E05F 1/1292; E05F 1/14; E05F 3/20; E05F 3/18; E05D 11/1021; E05D 3/12; E05D 3/14; E05D 3/16; E05D 11/10; E05D 15/40; E05D 15/401; E05D 15/405; E05D 15/406; E05D 15/42; E05D 15/58; E05D 15/565; E05D 3/142; E06B 3/5045; E05Y 2800/22; E05Y 2900/20; E05Y 2900/202; E05Y 2900/208; E05Y 2900/21; E05Y 2201/21; E05Y 2201/264; E05Y 2201/212; E05Y 2201/604; E05Y 2201/626; E05Y 2600/41
See application file for complete search history.

(56) References Cited

U.S. PATENT DOCUMENTS

2001/0039762 A1* 11/2001 Giovannetti ..... E05F 1/1091 49/246
2007/0124893 A1* 6/2007 Brustle ..... E05F 5/02 16/296
2010/0109497 A1* 5/2010 Blersch ..... E05D 15/408 312/405
2010/0269293 A1* 10/2010 Wisniewski ..... E05D 3/14 16/382
2015/0330128 A1* 11/2015 Ng ..... E05D 7/125 16/65
2016/0376823 A1* 12/2016 Huber ..... A47B 96/00 312/319.2
2019/0178016 A1* 6/2019 Salice ..... E05D 15/40
2019/0242167 A1* 8/2019 Salice ..... E05F 1/1058
2020/0123831 A1* 4/2020 Xu ..... E05D 3/16
2021/0087867 A1* 3/2021 Folie ..... E05F 1/1253
2021/0189780 A1* 6/2021 Nordieker ..... E05F 11/54
2021/0372178 A1* 12/2021 Lee ..... A47J 37/08

OTHER PUBLICATIONS

Written Opinion of the ISA for PCT/EP2020/057956 dated Jun. 24, 2020, 5 pages.

* cited by examiner

HINGE FOR THE OPENING AND CLOSING OF HINGED DOORS OF FURNITURE

This application is the U.S. national phase of International Application No. PCT/EP2020/057956 filed Mar. 23, 2020, which designated the U.S. and claims priority to IT Patent Application No. 102019000005758 filed Apr. 15, 2019, the entire contents of each of which are hereby incorporated by reference.

BACKGROUND OF THE INVENTION

Field of the Invention

The subject of the present invention is a hinge for the opening and closing of hinged doors of furniture, such as kitchen furniture and the like.

Description of the Related Art

Hinges of the type to which the invention relates are widely known and, in the case of a door with vertical rotation axis, with opening also known as flap, are arranged normally in the lower and in the upper part of the furniture unit between the door and the fixed structure.

In order to improve the side of the furniture unit aesthetically and at the same time remove from it the encumbrances of traditional hinges, there is currently the tendency to use hinges with four pins, or with two movement connecting rods, inserted in the base (lower plane) and in the cap (upper plane or top) of the furniture unit.

The two connecting rods act between the fixed structure of the furniture unit and the door, and on one of them acts a spring that is loaded during the opening movement of the door and exerts a pull force on the door in the final closing phase of the latter.

At least one shock absorber or damper is also provided, designed to dampen the closing movement, preventing the door from slamming.

In known hinges, the force of the spring is transferred to the movement connecting rod of the door by means of deflection levers, in particular a rocker lever, which as well as complicating the hinge structure also causes troublesome dragging of the rocker lever against the movement connecting rod during the opening and the closing of the door.

In addition, the damper used to dampen the closing movement of the door does not always perform its function in the best possible way, due to the way it is arranged in the hinge containment box.

WO 2016/174071 describes a hinge for hinged doors, in which there is a fixed axis spring housed in a box-like body and acting by means of a pawl on a cam profile of a rocker lever that connects two parts of a furniture unit in order to obtain a thrust in the closed position of the hinge.

SUMMARY OF THE INVENTION

The object of the invention is to eliminate, or at least reduce, the disadvantages of the known hinge of the above-mentioned type.

More particularly, an object of the invention is to provide a hinge for the opening and closing of hinged doors of furniture units that eliminates the dragging between metal parts during the opening and the closing of the door, which generates irritating noises.

Another object of the invention is to provide such a hinge that optimises the movement of opening and closing of the door.

Yet another object of the invention is to provide such a hinge wherein the structure and the function of the spring designed to facilitate the closure of the door are found to be highly reliable.

These and other objects are achieved by the hinge for the opening and closing of doors of furniture units as disclosed and claimed.

Advantageous embodiments of the invention are also disclosed.

Substantially, the hinge for the opening and the closing of hinged doors of furniture units according to the invention comprises a first fixed body designed to be housed in a seat of a horizontal plane of the structure of a furniture unit, such as a base or a top, and a second movable body designed to be housed in a seat of a door of the furniture unit, in order to actuate the door during opening and closing by means of a movement mechanism comprising at least one lever or connecting rod connecting a first pin placed on said fixed part of the hinge and a second pin placed on said movable part, wherein the closing force of the door is determined by spring means acting, with a tilting action, on an extension of said connecting rod beyond the first hinge pin. Said spring means comprise a compression spring held in position during tilting by a guide-spring stem sliding in a seat and having a head restrained to said extension of the connecting rod, the spring acting between said head of the rod and a stop around said seat.

BRIEF DESCRIPTION OF THE DRAWINGS

Further features of the invention will be made clearer by the detailed description that follows, referring to an embodiment thereof purely by way of a non-limiting example, illustrated in the accompanying drawings, in which:

FIG. 4 of maximum opening is enlarged with respect to the others and shows some parts in transparency for a better illustration.

DESCRIPTION OF THE PREFERRED EMBODIMENTS

Figure 1:
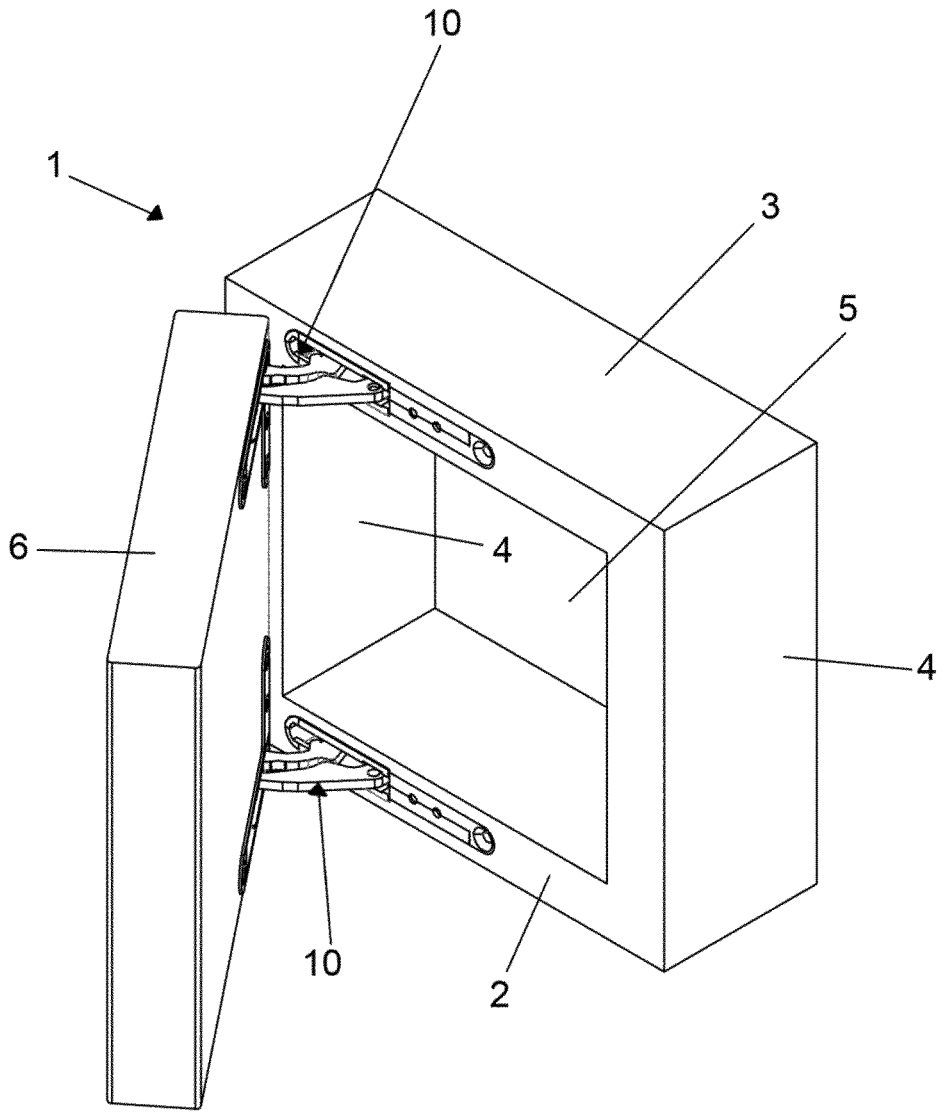
FIG. 1 shows schematically in perspective a furniture unit with hinged door in which hinges are used according to the invention.

FIG. 1 shows schematically a furniture unit 1 to illustrate the positioning and the functioning of the hinge according to the invention. Furniture unit 1 comprises a base or lower plane 2, a cap or upper plane or top 3, two side walls 4, a possible back wall 5 and a door 6.

Door 6 can have hinged or flap opening with respect to the structure of the furniture unit, by means of a pair of hinges 10 acting between the door itself and said lower 2 and upper 3 planes.

Naturally a hinge 10 can also be provided between door 6 and an intermediate plane (not shown) properly attached to the structure of the furniture unit.

Figure 2:
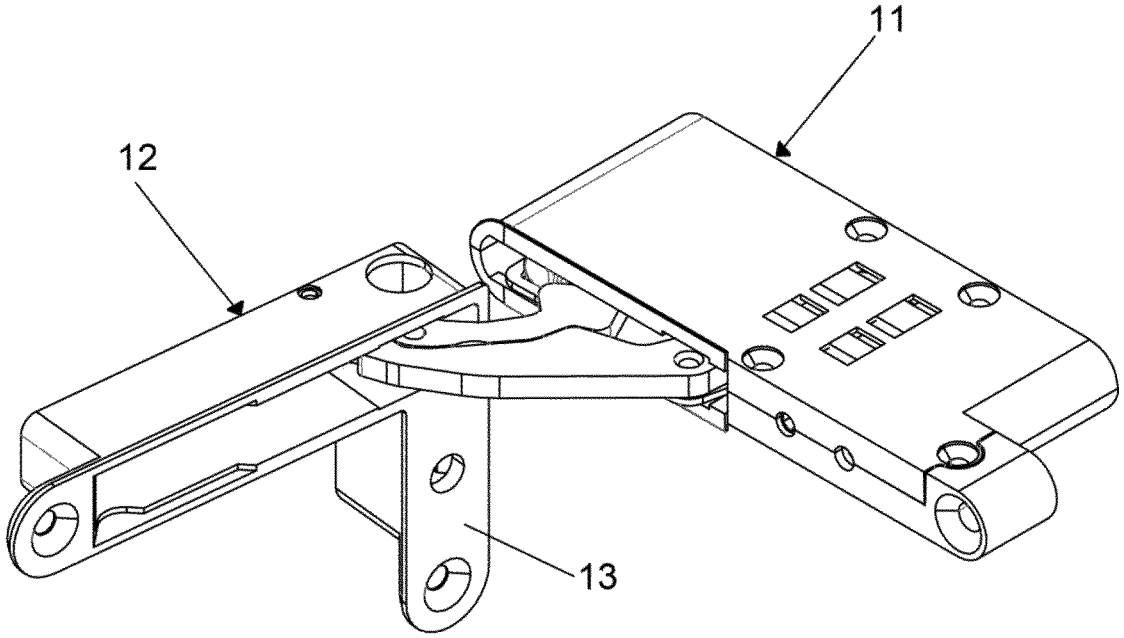
FIG. 2 is an assembled axonometric view of a hinge according to the invention, in particular for assembly in the upper part of the furniture unit of FIG. 1.

With particular reference to FIG. 2, hinge 10 comprises a first body or fixed body 11 that is inserted in a seat of a horizontal plane 2, 3 of the furniture unit, and a second body or mobile body 12 that is inserted instead in a seat of door 6.

The second body 12 of hinge 10 is made in two different conformations, with a section 13 that is oriented upwards or downwards, depending on whether the hinge is positioned at base 2 or top 3 of the furniture unit, as shown schematically in FIG. 1.

The hinge shown in FIG. 2 is depicted in the assembly position in the upper left corner of the furniture unit, corresponding to the hinge shown at the top in FIG. 1.

Figure 3:
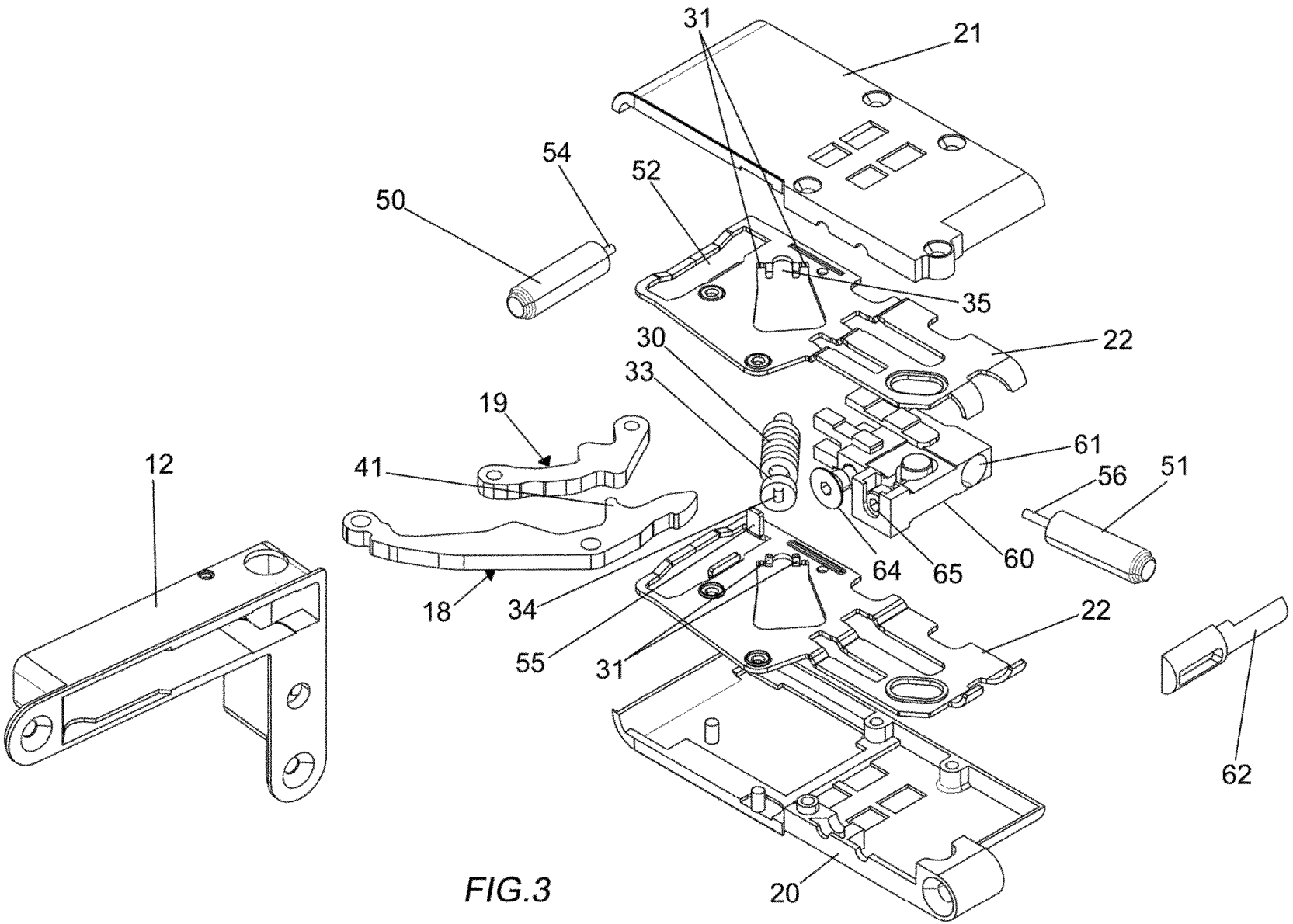
FIG. 3 is a blown-up axonometric view of the hinge of FIG. 2.

As can be seen in the blown-up view of FIG. 3, the first body 11 is made in two half-shells substantially identical one to the other, one lower or base 20 and one upper or cover 21, which accommodate a pair of plates or casings 22, between which the various components of the device are arranged.

In particular, hinge 10 is of the so-called type with four pins 14 and 15, 16 and 17, to which a pair of levers or connecting rods 18, 19 are restrained respectively, which accompany door 6, by means of the second body 12 of the hinge, during the opening and closing movement.

The two connecting rods 18, 19, which join the two bodies 11, 12 of hinge 10, have a shape slightly arched in the same direction.

The connecting rod 18, which we will refer to as external connecting rod, is jointed at the hinge pin 15 carried by the body 12 attached to the door at one of its ends, and at the pin 14 to the body 11 attached to the structure of the furniture unit at one of its intermediate points.

The connecting rod 19, which we shall refer to as internal connecting rod, is instead jointed at pins 16, 17 of bodies 11, 12 at its respective ends.

The external connecting rod 18 is under the action of a compression spring 30, which acts with one of its ends at an internal protrusion 41 of an extension 40 of the connecting rod 18 beyond hinge pin 14, and tilting with respect to this protrusion 41.

The other end of the spring 30 rests against a stop 31 formed between the two casings 22.

In particular, inside the spring 30 there is a guide-spring stem 32 with a head 33 provided with a recess 34 (FIG. 3) for engagement with the protrusion 41 of the connecting rod 18.

The stem 32 is inserted in a seat 35 formed between the two casings 22, inside said stop 31, where it can slide to allow the tilting of the spring 30.

Figure 4:
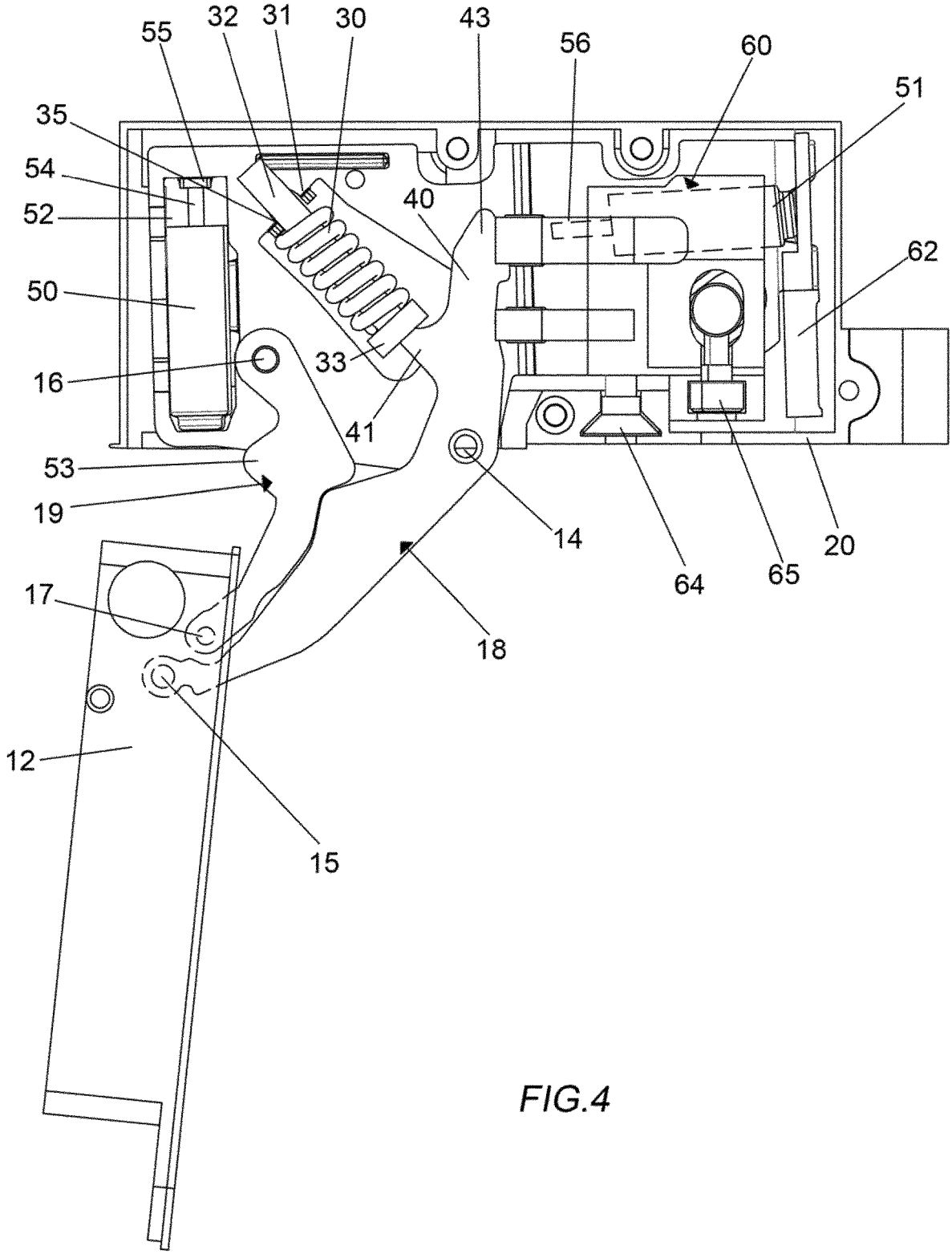
FIGS. 4 to 8 are plan views from above of the hinge of FIG. 2 with the cover of the hinge body removed to show the internal components; the various drawings show a sequence of positions during the closing of the door, the opening taking place in reverse sequence.
Figure 5:
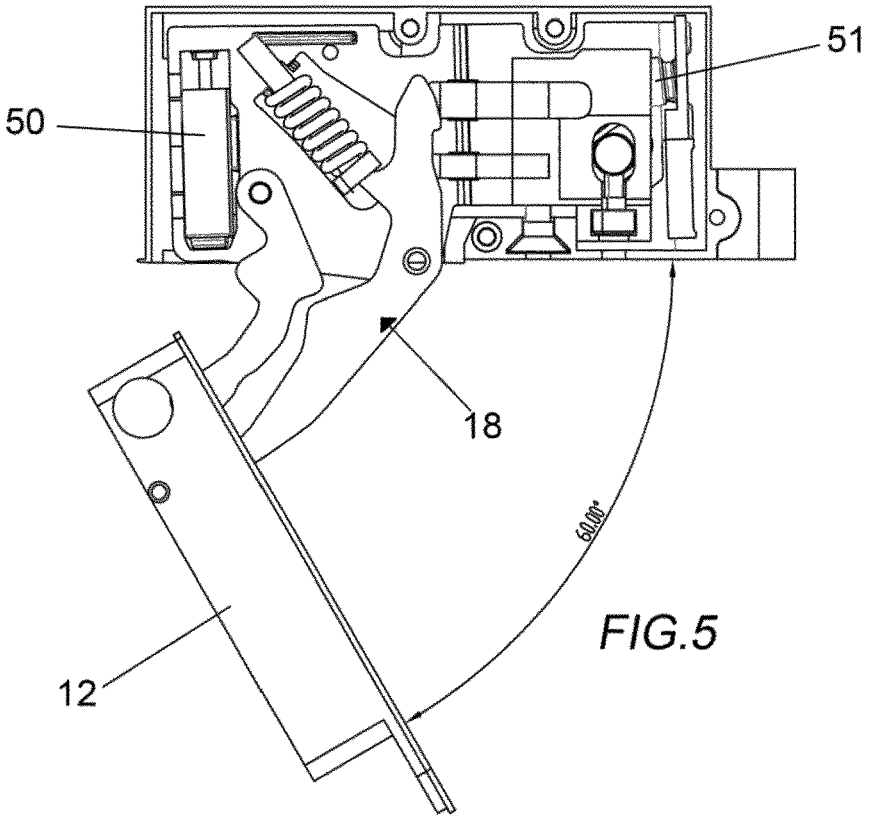
Figure 6:
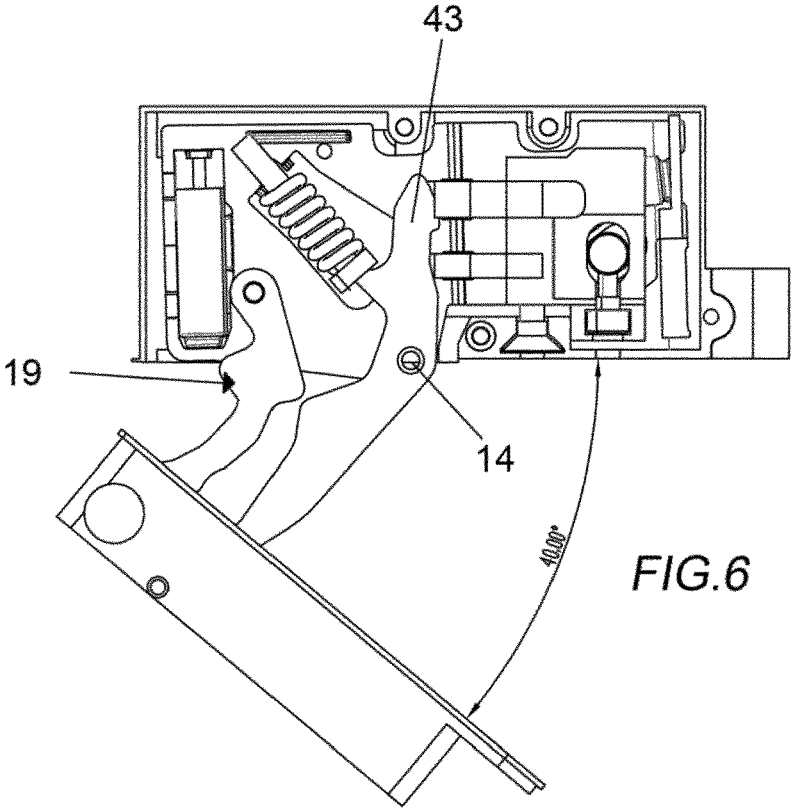
Figure 8:
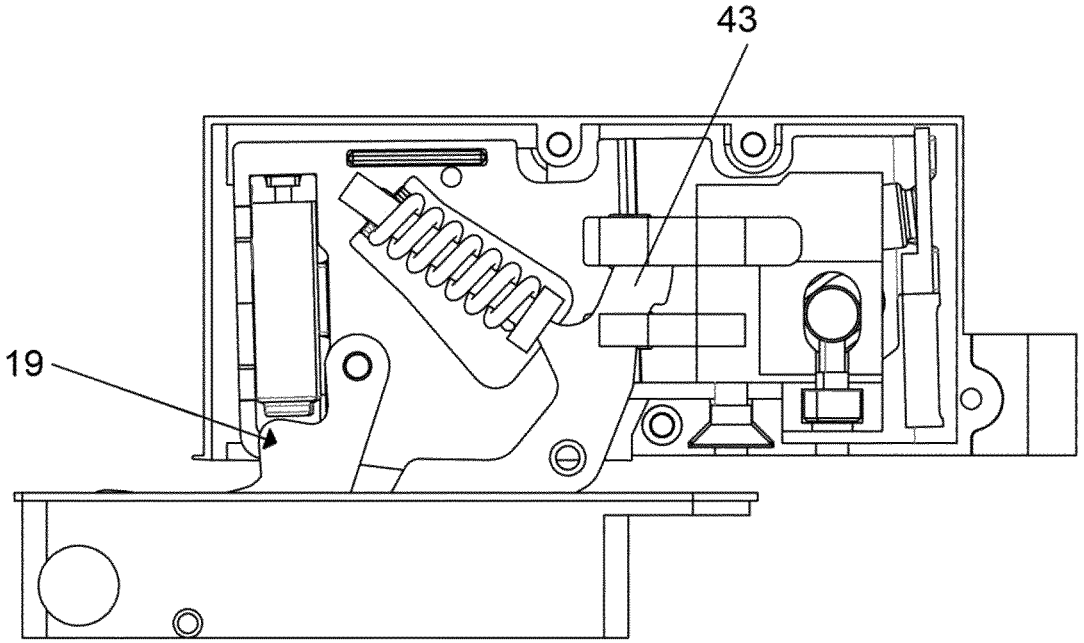

During the opening movement of the door 6, which assumes in succession the positions shown in the sequence of drawings backwards, from FIG. 8 to FIG. 4, the spring 30 is loaded, and the stored energy is returned by the spring in the closing phase.

Figure 7:
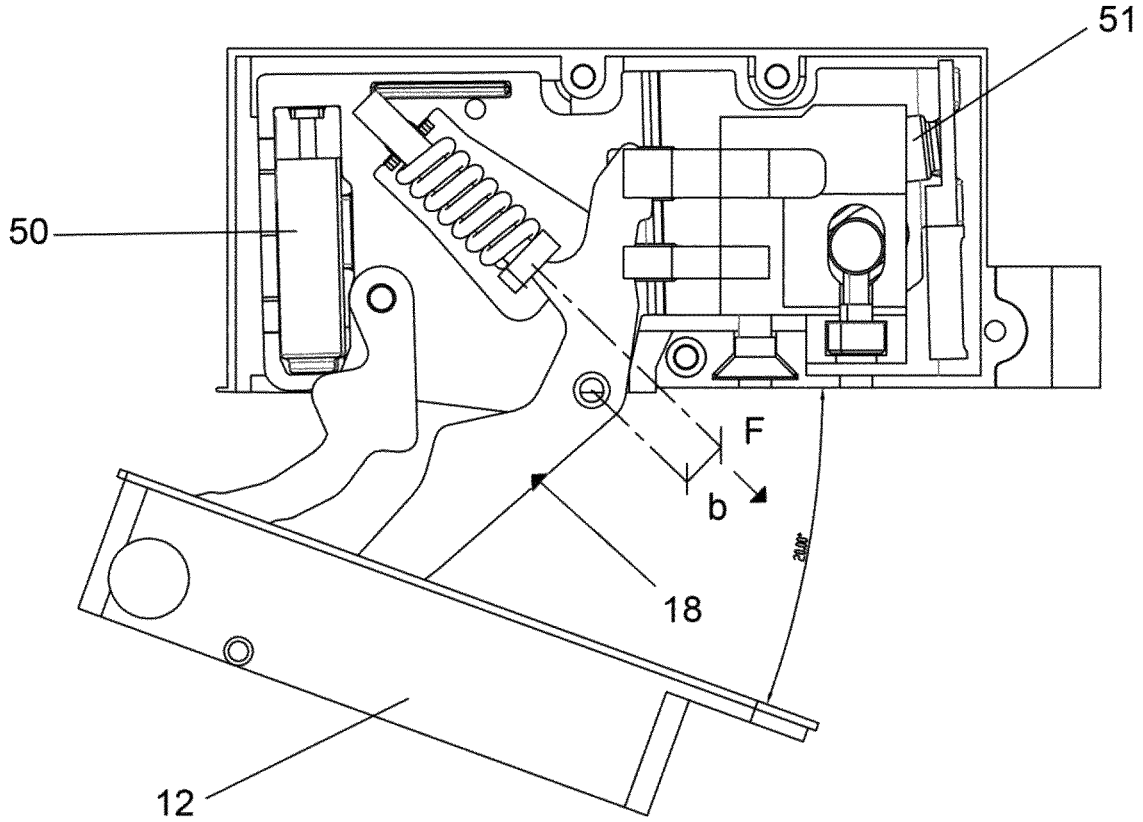

In particular, during closing, starting from the condition of maximum opening of the door shown in FIG. 4, which is about 100°, the spring 30 is almost inactive up to the condition of FIG. 7 (dead point condition), that is at an opening angle of about 20°, from where it starts to unload by exerting a torque on the external connecting rod 18, given by the force F of the spring for the arm b, shown in FIG. 7, thus causing the automatic closing of the hinge and therefore of the door, as shown in FIG. 8.

To prevent the door slamming against the fixed structure of the furniture unit during closing, due to the force exerted by the spring 30, a pair of dampers or decelerators 50, 51 are provided, designed to soften the movement of closing of the door.

In particular, the damper 50 is restrained to slide linearly in a seat 52 formed between the two casings 22, and is actuated by a nose 53 of the internal connecting rod 19. The stem 54 of the damper 50 abuts against a stop tab 55 formed on the lower casing 22.

The other damper 51 is constrained to slide linearly in a seat 61 formed in an adjustment body 60, and its stem 56 is actuated by the free end 43 of the external connecting rod 18.

The end of the damper 51 opposite the stem 56 abuts against an additional stop 62, as shown in the drawings, or directly against a stop formed on one of the two casings 22.

The adjustment body 60 is not further described, in that it does not form a specific object of the invention. It has a front adjustment screw 64 and a side adjustment screw 65, respectively, to move the entire hinge assembly slightly forwards-backwards and sideways.

The direct action of the spring 30 on the external connecting rod 18 avoids the annoying dragging between metal parts that occurs in devices of the prior art using an additional rocker lever interposed between the spring and a lever or connecting rod for actuation of the door.

The tilting assembly of the spring 30 on the guide-spring stem 32 with head 33 allows a thrust on a tilting contact point on the connecting rod 18, avoiding any dragging.

In addition, the providing of the double shock absorbers 50, 51, with which connecting rods 19, 18 respectively work, allows the movement of the door to be dampened efficiently when closing.

From what has been disclosed above, the advantages of the invention with respect to the prior art appear clear.

Although in the description above there was mention of a spring 30, it is clear that a group of springs acting on the external connecting rod 18 can be provided, and also the compression spring can be replaced by a traction spring, modifying the structure thereof appropriately.

Naturally the invention is not limited to the particular embodiment previously described and illustrated in the accompanying drawings, but numerous detailed changes may be made thereto, without departing from the scope of the invention itself, as defined by the appended claims.

The invention claimed is:

1. Hinge for the opening and the closing of hinged doors of furniture units, comprising a first fixed body designed to be housed in a seat of a horizontal plane of the structure of a furniture unit, and a second movable body designed to be housed in a seat of a door of the furniture unit, to actuate the door in the opening and closing positions by means of a movement mechanism comprising at least one lever or connecting rod connecting a first pin placed on said fixed part of the hinge and a second pin placed on said movable part, in which the closing force of the door is determined by spring means, wherein said spring means act, with a tilting action, on an extension of said connecting rod beyond said first hinge pin, wherein said spring means comprise a compression spring held in position during tilting by a guide-spring stem sliding in a seat and having a head restrained to said extension of the connecting rod, the spring acting between said head of the stem and a stop around said seat.

2. The hinge according to claim 1, wherein said head of the guide-spring stem has a recess designed to engage with a protrusion of said extension of the connecting rod.

3. The hinge according to claim 2, further comprising a damper against which said extension of the connecting rod acts during closure of the door.

4. The hinge according to claim 3, further comprising a second connecting rod connecting a pin placed on the fixed body of the hinge and a pin placed on said movable body, said second connecting rod co-operating with the connecting rod for the actuation of the door during opening and closing.

5. The hinge according to claim 4, further comprising a damper against which a nose of said second connecting rod acts when closing the door.

6. The hinge according to claim 3, wherein said fixed body is made of two half-shells, which house a pair of casings, between which the various components of the hinge are arranged.

7. The hinge according to claim 2, further comprising a second connecting rod connecting a pin placed on the fixed body of the hinge and a pin placed on said movable body, said second connecting rod co-operating with the connecting rod for the actuation of the door during opening and closing.

8. The hinge according to claim 7, further comprising a damper against which a nose of said second connecting rod acts when closing the door.

9. The hinge according to claim 7, wherein said fixed body is made of two half-shells, which house a pair of casings, between which the various components of the hinge are arranged.

10. The hinge according to claim 2, wherein said fixed body is made of two half-shells, which house a pair of casings, between which the various components of the hinge are arranged.

11. The hinge according to claim 1, further comprising a damper against which said extension of the connecting rod acts during closure of the door.

12. The hinge according to claim 11, further comprising a second connecting rod connecting a pin placed on the fixed body of the hinge and a pin placed on said movable body, said second connecting rod co-operating with the connecting rod for the actuation of the door during opening and closing.

13. The hinge according to claim 12, further comprising a second damper against which a nose of said second connecting rod acts when closing the door.

14. The hinge according to claim 12, wherein said fixed body is made of two half-shells, which house a pair of casings, between which the various components of the hinge are arranged.

15. The hinge according to claim 11, wherein said fixed body is made of two half-shells, which house a pair of casings, between which the various components of the hinge are arranged.

16. The hinge according to claim 1, further comprising a second connecting rod connecting a pin placed on the fixed body of the hinge and a pin placed on said movable body, said second connecting rod co-operating with the connecting rods for the actuation of the door during opening and closing.

17. The hinge according to claim 16, further comprising a damper against which a nose of said second connecting rod acts when closing the door.

18. The hinge according to claim 17, wherein said fixed body is made of two half-shells, which house a pair of casings, between which the various components of the hinge are arranged.

19. The hinge according to claim 16, wherein said fixed body is made of two half-shells, which house a pair of casings, between which the various components of the hinge are arranged.

20. The hinge according to claim 1, wherein said fixed body is made of two half-shells, which house a pair of casings, between which the various components of the hinge are arranged.

* * * * *